US009334550B2

(12) United States Patent
Hamilton

(10) Patent No.: US 9,334,550 B2
(45) Date of Patent: May 10, 2016

(54) METHOD OF CONTROLLING THE CARBON OR OXYGEN CONTENT OF A POWDER INJECTION

(75) Inventor: Hugh Gavin Charles Hamilton, Reading (GB)

(73) Assignee: ANGLO PLATINUM MARKETING LIMITED, London (GB)

( * ) Notice: Subject to any disclaimer, the term of this patent is extended or adjusted under 35 U.S.C. 154(b) by 846 days.

(21) Appl. No.: 13/501,898

(22) PCT Filed: Oct. 13, 2010

(86) PCT No.: PCT/GB2010/051724
§ 371 (c)(1),
(2), (4) Date: Jun. 25, 2012

(87) PCT Pub. No.: WO2011/045601
PCT Pub. Date: Apr. 21, 2011

(65) Prior Publication Data

US 2012/0258008 A1 Oct. 11, 2012

(30) Foreign Application Priority Data

Oct. 14, 2009 (GB) ..... 0917988.8

(51) Int. Cl.

| | |
|---|---|
| ***B22F 1/02*** | (2006.01) |
| ***B22F 3/02*** | (2006.01) |
| ***B22F 3/12*** | (2006.01) |
| ***C22C 14/00*** | (2006.01) |
| ***B22F 3/22*** | (2006.01) |

(52) U.S. Cl.
CPC ..... *C22C 14/00* (2013.01); *B22F 1/025* (2013.01); *B22F 3/225* (2013.01); *B22F 2998/10* (2013.01)

(58) Field of Classification Search
CPC ..... B22F 1/025; B22F 3/02; B22F 3/225; B22F 2998/10; C22C 14/00
USPC ..... 419/45, 64, 66; 264/109; 75/228
See application file for complete search history.

(56) References Cited

U.S. PATENT DOCUMENTS

| | | | | |
|---|---|---|---|---|
| 4,474,731 | A * | 10/1984 | Brownlow et al. | 419/5 |
| 4,778,549 | A * | 10/1988 | Cowan et al. | 156/89.18 |
| 5,064,463 | A | 11/1991 | Ciomek | |
| 5,882,802 | A | 3/1999 | Ostolski | |

(Continued)

FOREIGN PATENT DOCUMENTS

| | | | |
|---|---|---|---|
| CA | 2567536 | A1 | 12/2005 |
| EP | 1813367 | A2 | 8/2007 |

(Continued)

OTHER PUBLICATIONS

English translation of JP 06/145704; 8 pages; May 1994.*

(Continued)

*Primary Examiner* — Helene Klemanski
(74) *Attorney, Agent, or Firm* — Young & Thompson

(57) ABSTRACT

The present invention relates to a method for controlling the carbon and/or oxygen content in a material by forming a feedstock composition comprising at least one powder, at least one platinum group metal and at least one binder; and forming the material by powder injection molding;

wherein at least a proportion of the carbon and/or oxygen is catalytically removed by the at least one platinum group metal.

16 Claims, 5 Drawing Sheets

(56) References Cited

U.S. PATENT DOCUMENTS

| | | | | |
|---|---|---|---|---|
| 5,888,446 | A | 3/1999 | Casey et al. | |
| 6,287,445 | B1 | 9/2001 | Lashmore et al. | |
| 2005/0196312 | A1 | 9/2005 | Nyberg et al. | |
| 2007/0178005 | A1 | 8/2007 | Broadley et al. | |
| 2008/0199822 | A1 | 8/2008 | Blomacher et al. | |
| 2010/0028699 | A1 | 2/2010 | Lenk et al. | |
| 2011/0281132 | A1* | 11/2011 | Hamilton et al. | 419/64 |

FOREIGN PATENT DOCUMENTS

| | | | |
|---|---|---|---|
| JP | 63-206402 | A | 8/1988 |
| JP | 03-64402 | | 3/1991 |
| JP | 06-145704 | | 5/1994 |
| JP | 6-145837 | A | 5/1994 |
| JP | 2000-219902 | A | 8/2000 |
| JP | 2003-252676 | | 9/2003 |
| WO | 2007-007518 | | 1/2007 |
| WO | 2008-071720 | | 6/2008 |
| WO | 2010-058200 | | 5/2010 |
| WO | WO-2010/058223 | A1 | 5/2010 |

OTHER PUBLICATIONS

German et al., *Injection Molding of Metals and Ceramics* (Princeton, New Jersey: Metal Powder Industries Federation, 1997), p. 91.

Froes, "Getting better: big boost for titanium MIM prospects," *Metal Powder Report*, Dec. 2006, vol. 61, Issue 11, pp. 20-23.

"Titanium and Titanium Alloys," *Kirk-Othmer: Encyclopaedia of Chemical Technology*, 4th Edition, vol. 24, pp. 186-224.

International Search Report dated Dec. 3, 2010, from PCT International Application No. PCT/GB2010/051724.

British Search Report dated Jan. 27, 2010, from British Patent Application No. 0917988.8.

* cited by examiner

FIGURE 1C
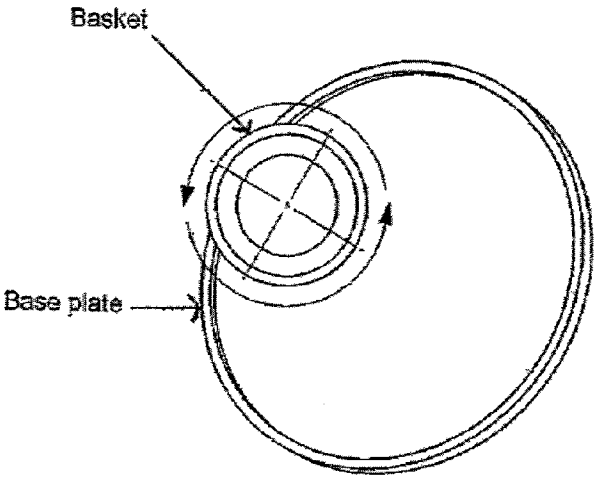
FIGURE 1A
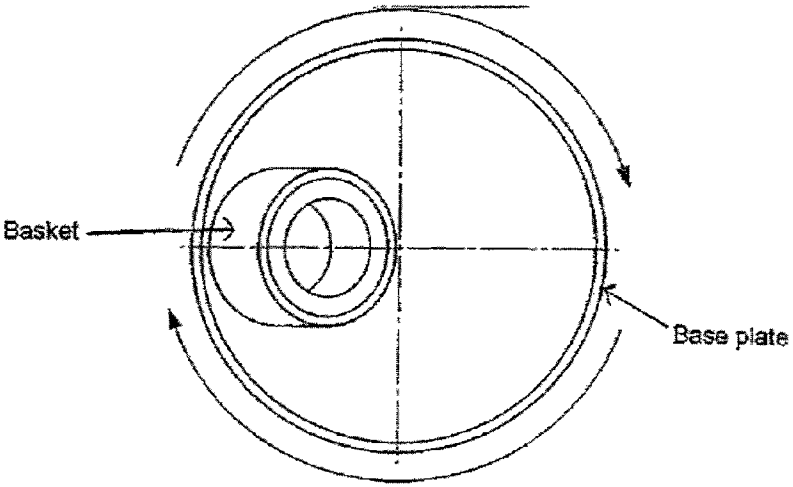
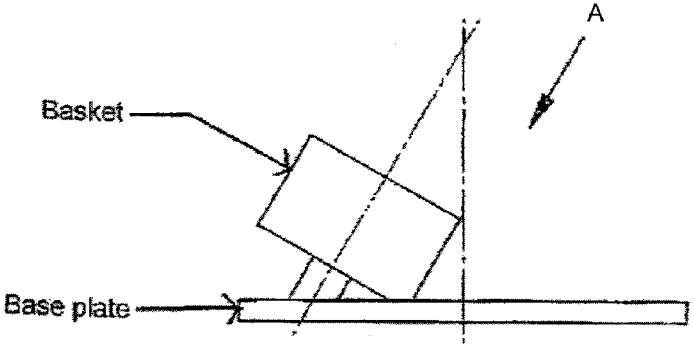
FIGURE 1B

METHOD OF CONTROLLING THE CARBON OR OXYGEN CONTENT OF A POWDER INJECTION

CROSS-REFERENCE TO RELATED APPLICATIONS

This application is the U.S. National Phase application of PCT International Application No. PCT/GB2010/051724, filed Oct. 13, 2010, and claims priority of British Patent Application No. 0917988.8, filed Oct. 14, 2009, the disclosures of both of which are incorporated herein by reference in their entireties for all purposes.

FIELD OF THE INVENTION

The present invention relates to a method for controlling the carbon and/or oxygen content in a material formed by powder injection molding. In particular, the invention provides an alloy, preferably a titanium alloy, or a cermet having an improved purity.

BACKGROUND OF THE INVENTION

A very wide range of metal alloys are used for different applications, each alloy offering a particular combination of properties, including strength, ductility, creep resistance, corrosion resistance, fatigue resistance and castability. For example, although pure titanium is highly resistant to corrosion, its corrosion resistance can be improved by forming an alloy with 0.15 wt % palladium. Likewise, Ti-6Al-4V is a popular titanium alloy which displays high strength, creep resistance, fatigue resistance and castability. The corrosion resistance of Ti-6Al-4V may also be similarly improved by the addition of palladium.

The global production of titanium is small in comparison with other metals or alloys and the majority of titanium currently produced is for use in the aerospace industries. Other industries, however, have encountered difficulties in sourcing the material they require and have additionally found it undesirable to maintain a large stock of a range of different titanium alloys as a result of the high price of titanium.

Cermets have been designed so that they display characteristics of both the ceramic and metallic components. In this regard, the ceramic component may contribute a high temperature resistance and hardness, while the metal component can contribute plastic deformation. Cermets have found use in the electronics industry (in the manufacture of resistors and capacitors), ceramic-to-metal joints and seals, as well as in medical applications, such as dentistry.

Powder injection molding (PIM) is a well-known method for producing tailored compositions (see, for example, "Injection Molding of Metals and Ceramics" by Randall M. German and Animesh Bose, MPIF Publishers, 1997 (ISBN No. 1-878-954-61-X), which is herein incorporated by reference in its entirety for all purposes). Generally, PIM involves mixing a powder and a binder to form a feedstock, which is then granulated and injection molded to form a "green" body. The green body is then transformed into a "brown" body by removing the binder. The process of debinding may be thermal, the binder can be removed by solvent extraction, or a combination of both methods. Regardless of the method by which the brown body is generated, the final step of the process involves sintering to produce what is known as a "white" body.

One disadvantage associated with PIM in relation to powders having an affinity for reaction with process gases (such as hydrogen, oxygen or nitrogen) is the need for the maintenance of a high level of purity throughout the fabrication process. Depending upon the metal powder being processed, poor control of process gases and temperature excursions can lead to the formation of undesirable levels of, for example, oxide, nitride or hydride impurities within sintered metal bodies. Using the case of titanium PIM as an example, it is well-known that the formation of titanium oxides, nitrides or hydrides can occur under the temperature conditions used during PIM processing and in the presence of, respectively, oxygen, nitrogen or hydrogen. It has been observed that the presence of interstitial alloying elements can have large effects on the properties of alloys and, as such, are carefully specified within standard alloy compositions (see, for example, "Titanium and Titanium Alloys" in Kirk-Othmer: Encyclopaedia of Chemical Technology, $4^{th}$ Edition, Vol. 24, pg 186-224, which is hereby incorporated by reference in its entirety for all purposes).

A second disadvantage associated with PIM is that the presence of relatively large amounts of organic material in the green bodies, required as the binder effects efficient and reproducible molding operations, can lead to undesirable levels of carbon-based impurities in the final sintered bodies. The use of unsuitable binder compositions and/or of poor process control during the debinding and sintering stages can result in incomplete removal of the binder material, which can become entrapped within the final, sintered body. In the case of titanium and titanium alloys, for example, the presence of carbon impurities is usually specified at a low level, typically less than 0.1%, to avoid the emergence of a brittle and solid carbide phase at levels greater that 0.2% in the alloy (see, for example, the ASTM International list of titanium alloy standards, which is herein incorporated by reference in its entirety for all purposes).

In addition to the possibility of binder formulations generating carbon-based impurities in the white bodies, the interplay between the selection of a binder formulation and the process conditions for the removal of the binder can cause the formation of further undesirable oxygen-, hydrogen- and nitrogen-based impurities in the final sintered bodies. For example, Tables II and III in "Getting better: big boost for titanium MIM prospects" by S. Froes (in Metal Powder Report Volume 61, Issue 11, December 2006, Pages 20-23, which is hereby incorporated by reference in its entirety for all purposes) respectively list a selection of titanium alloy PIM binder compositions and the properties of the sintered alloys produced using those compositions, primarily on laboratory-scale processes. The majority of debinding processes involve thermal- or solvent-based processes or, on occasion, a combination of both. Whilst the solvent-based processes have been shown to be capable of producing sintered titanium bodies with low impurity levels, volumes of contaminated solvent are produced as waste streams that require subsequent handling and disposal. It is evident from a review of these Tables that achieving sintered alloy components with ASTM standard levels of impurities remains a challenge for many practitioners.

Insofar as thermally-based debinding processes are concerned, it is understood that these types of processes would negate the problems associated with disposal of liquid effluent. However, as Froes comments in the afore-referenced article, even those polymer binders known to readily thermally "unzip" to their starting monomers can still leave undesirable residues in sintered titanium MIM bodies. Depolymerization, or unzipping, tends to occur at temperatures close to those where impurity uptake becomes non-negligible, suggested to be at or above 260° C. for components comprising titanium.

US20080199822 (to BASF) describes an apparatus for the continuous catalytic removal of binder from metallic and/or ceramic shaped bodies produced by powder injection molding. The process involves the use of gaseous nitric acid that reacts with the binder. US20080199822, however, is silent with regard to the reduction of the carbon and/or oxygen content which occurs as a result of binder residues remaining in the brown parts. Nor does US20080199822 appear to describe the maintenance of a good level of purity throughout the PIM process.

SUMMARY OF THE INVENTION

The present invention seeks to overcome the above-mentioned disadvantages. In particular, it has been found that the presence of a platinum group metal in a feedstock composition can result in the manufacture of finished sintered bodies having lower impurity concentrations than similar bodies formed without the inclusion of the platinum group metal. Accordingly, the invention provides a method for controlling the carbon and/or oxygen content in a material comprising the steps of:

a) forming a feedstock composition comprising at least one powder, at least one platinum group metal and at least one binder; and b) forming the material by powder injection molding;

wherein at least a proportion of the carbon and/or oxygen is catalytically removed by the at least one platinum group metal.

In one embodiment, the invention provides a method for controlling the carbon content in a material. In one preferred embodiment, the carbon content is controlled to a level of ≤0.1 wt % carbon in the final sintered body.

In another embodiment, the invention provides a method for controlling the oxygen content in a material. In one preferred embodiment, the oxygen content is controlled to a level of ≤0.3 wt % oxygen in the final sintered body.

BRIEF DESCRIPTION OF THE DRAWINGS

The invention is illustrated by the accompanying drawings in which:

FIGS. 1A-C illustrate how the centrifugal forces are applied to the particles in the Speedmixer™. FIG. 1A is a view from above showing the base plate and basket. The base plate rotates in a clockwise direction.

FIG. 1B is a side view of the base plate and basket.

FIG. 1C is a view from above along line A in FIG. 1B. The basket rotates in an anti-clockwise direction.

DETAILED DESCRIPTION OF THE INVENTION

Figure 2:
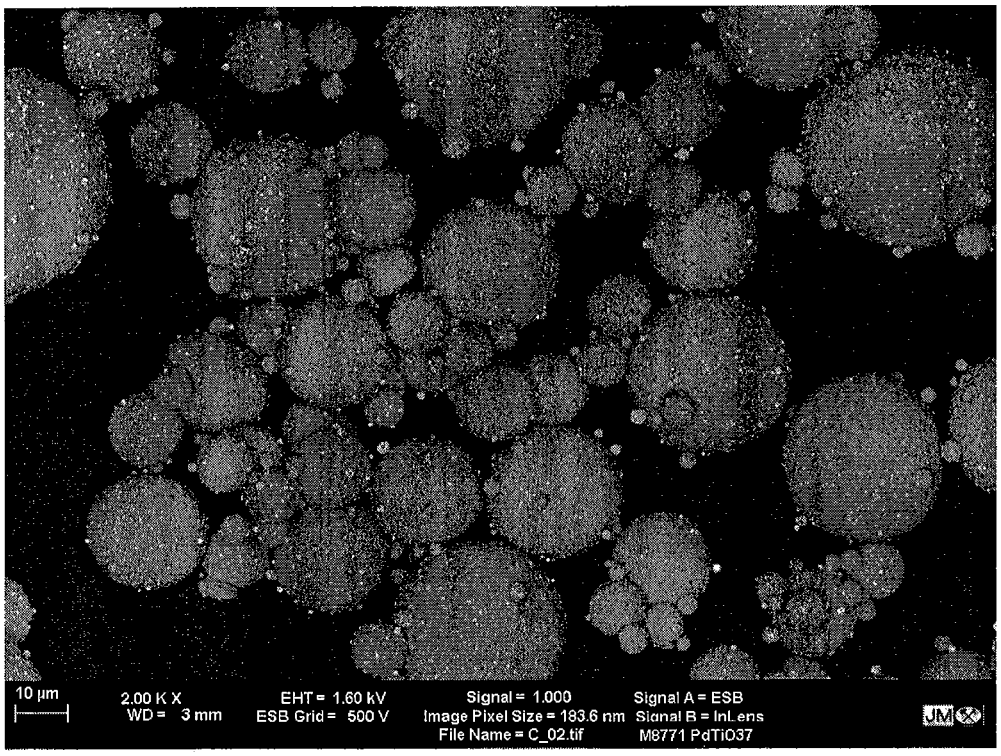
FIG. 2 is a backscattered electron image of 10 g titanium powder (<45 μm) coated with 0.2 wt % palladium. The dual asymmetric centrifugal forces were applied for 20 seconds at 1000 rpm and 20 seconds at 2000 rpm.

According to an embodiment, the invention provides a method for controlling the carbon and oxygen content in a material. The material may be an alloy and, in this respect, the powder of the feedstock composition will therefore be metallic and preferably comprises at least one of titanium, molybdenum, tungsten, nickel or iron. When the powder comprises a single metal, titanium (e.g. commercially available titanium) is preferred. When the powder comprises more than one metal in the form of one or more alloys, titanium alloys (e.g. Ti-6Al-4V) or iron alloys (e.g. steel and, in particular, stainless steel) are preferred. In one particularly preferred embodiment, the powder comprises at least one reactive metal. In one especially preferred embodiment, the powder comprises titanium or titanium alloys. Alternatively, the powder may comprise an admix of metals.

When the material is an alloy and the powder comprises at least one metal, the PIM process is known as metal powder injection molding or metal injection molding (MIM). In one preferred embodiment the material is formed by metal injection molding.

In an alternative embodiment, the material is a cermet. In this respect, a proportion of the powder of the feedstock composition will be ceramic and preferably comprises at least one of silicon, zirconium, aluminium, yttrium, cerium, titanium or tungsten. The ceramic may comprise one or more carbides, borides or oxides, for example, silicon oxide, aluminium oxide, zirconium oxide, silicon carbide, tungsten carbide, titanium carbide or titanium oxide.

Suitably, the powder comprises particles which may be substantially spherical, irregular or a combination thereof.

The platinum group metal may be selected from the group consisting of at least one of platinum, palladium, rhodium, ruthenium, iridium and osmium. More preferably, the platinum group metal is selected from the group consisting of at least one of platinum, palladium, rhodium, ruthenium and iridium and even more preferably from the group consisting of at least one of platinum and palladium. A particularly preferred platinum group metal is palladium (for example, palladium black).

The platinum group metal may be present in any suitable quantity. For example, the platinum group metal may typically be present in a range from about 0.01 wt % to about 50 wt % in the final sintered body. Typically, the platinum group metal is present in the range of about 0.01 wt % to about 0.25 wt % for titanium alloys as per ASTM standards.

The feedstock composition may be an admixture of the powder, the platinum group metal and the binder. In this regard, the powder, the platinum group metal and the binder may be combined in any suitable order.

Alternatively, the platinum group metal may be coated onto the powder prior to the formation of the feedstock composition. In this respect, the platinum group metal may be coated onto the powder by low energy ball milling, electroless plating, reductive chemical deposition or using dual asymmetric centrifugal forces. Preferably, the platinum group metal is coated onto the powder using dual asymmetric centrifugal forces.

By "dual asymmetric centrifugal forces" we mean that two centrifugal forces, at an angle to each other, are simultaneously applied to the particles. In order to create an efficient mixing environment, the centrifugal forces preferably rotate in opposite directions. The Speedmixer™ by Hauschild (http://www.speedmixer.co.uk/index.php) utilises this dual rotation method whereby the motor of the Speedmixer™ rotates the base plate of the mixing unit in a clockwise direction (see FIG. 1A) and the basket is spun in an anti-clockwise direction (see FIGS. 1B and 1C).

When the powder comprises substantially spherical particles, the particles maintain their shape during the high-energy coating process. The production of substantially spherical coated particles is advantageous because the flowability of the coated particles is improved, which assists in downstream processing. While not wishing to be bound by theory, it is believed that the coating process results in a physical change in the primary and secondary particles whereby the particles are physically cojoined.

The coating process may be controlled by various parameters including the rotation speed at which the process takes place, the length of processing time, the level to which the mixing container is filled and/or the use of milling media.

The dual asymmetric centrifugal forces may be applied for a continuous period of time. By "continuous" we mean a period of time without interruption. Preferably, the period of time is about 1 second to about 10 minutes, more preferably about 5 seconds to about 5 minutes and most preferably about 10 seconds to about 1 minute. An especially preferred period of time is 20 seconds.

Alternatively, the dual asymmetric centrifugal forces may be applied for an aggregate period of time. By "aggregate" we mean the sum or total of more than one periods of time. The advantage of applying the centrifugal forces in a stepwise manner is that excessive heating of the powder and platinum group metal can be avoided. The dual asymmetric centrifugal forces are preferably applied for an aggregate period of about 1 second to about 10 minutes, more preferably about 5 seconds to about 5 minutes and most preferably about 10 seconds to about 1 minute. The number of times (e.g. 2, 3, 4, 5 or more times) in which the dual asymmetric centrifugal forces are applied will depend upon the nature of the powder and platinum group metal. For example, when the powder comprises titanium, stepwise application of the centrifugal forces minimises heating of the particles thus minimising the risk of oxidation and/or combustion. In a particularly preferred embodiment, the dual asymmetric centrifugal forces are applied in a stepwise manner with periods of cooling therebetween.

Preferably, the speed of the dual asymmetric centrifugal forces is from about 200 rpm to about 3000 rpm. More preferably, the speed is from about 300 rpm to about 2500 rpm. Even more preferably, the speed is from about 500 rpm to about 2000 rpm.

The level to which the mixing container is filled is determined by various factors which will be apparent to the skilled person. These factors include the apparent density of the powder and platinum group metal, the volume of the mixing container and the weight restrictions imposed on the mixer itself.

When the powder is metallic, the coating of the powder with the platinum group metal may be assisted using milling media. Milling media use friction and impact to breakdown the secondary particles and effectively coat the surface of the primary particles. The media should be hard and non-contaminating. Preferably the milling media is a ceramic material, such as $ZrO_2$. However, other ceramic materials, for example $Al_2O_3$ or $TiO_2$, are also suitable, provided they are hard enough. If a residue is left, it must be benign.

When the powder is ceramic, the particles themselves act as milling media.

In one embodiment, the powder has particles with an average diameter of about ≤2000 μm, more preferably about ≤1500 μm and even more preferably, about ≤1000 μm. In one embodiment, the particles have an especially preferred average diameter of about 1 μm to about 45 μm when the powder comprises titanium.

Preferably, the platinum group metal may be single crystallites or an agglomerate of many smaller crystallites. However, the secondary particles need not necessarily be substantially spherical in shape.

The coating of the platinum group metal on the powder particles may be in the form of a film or in the form of discrete particles. The degree of coverage will depend on the ductility of the platinum group metal, the length of time allowed for the coating process and/or the quantity of the platinum group metal present e.g. palladium may be added to titanium alloys in a proportion of about 0.05% to about 0.25%, e.g. about 0.05% to about 0.2%, which are recognisable as the levels of addition in ASTM/ASME Ti grades 7, 11, 16, 17, 18, 20, 24 and 25. The quantity of platinum group metal can also affect one or more properties of a desired alloy or cermet subsequently formed. For example, when the quantity of Pd is increased in a Pd/Ti alloy, the corrosion resistance of the alloy to chloride-containing solutions (such as salt water) improves.

Regardless of the method by which the platinum group metal is incorporated into the feedstock composition, the platinum group metal is preferably distributed throughout the feedstock composition substantially homogeneously (for example, by being coated onto the powder prior to the formation of the feedstock composition or by being mixed thoroughly with the powder and the binder during the preparation of the feedstock composition). The substantially homogeneous distribution is thus preferably present in the "green", "brown" and final sintered bodies.

The binder may be any suitable binder compatible with PIM. The science of the use of binders and the processes by which binder removal occurs are well documented, for example, in "Injection Molding of Metals and Ceramics" by Randall M. German and Animesh Bose, MPIF Publishers, 1997 (ISBN No. 1-878-954-61-X), which is hereby incorporated by reference in its entirety for all purposes. Table 4.3 on page 91 of the above reference lists 24 example binder formulations, many employing components such as stearic acid, glycerine, polymethylmethacrylate, paraffin wax or carnauba wax. A particularly preferred binder is the binder developed by Egide UK.

The temperature at which the brown body is formed (i.e. the debind temperature) may be any suitable temperature.

Without wishing to be bound by theory, it is believed that the carbon content in the final sintered bodies is derived from residues of the binder which remain within the debound brown bodies and become entrapped during the sintering process. In addition, the oxygen content in the final sintered bodies can originate from more than one source, for example, from the surface oxide films present on the original powder, from the oxidising gases present during the PIM processing and/or from the organic binder materials, some of which will have oxygen as one of their elemental components. In this regard, it is further believed that control of the carbon and/or oxygen content according to the present invention proceeds via a catalytic removal of at least a proportion of the binder and/or of residual binder components resulting from the unzipping process. As such, the overall process of debinding occurs as a result of a combination of unzipping and the catalytic removal process. The quantity of binder and/or residual binder components removed catalytically will vary with a number of parameters, which include, but are not limited to, the starting composition of the binder, the amount and distribution of the platinum group metal, the thermal processing conditions selected, and the process gas used to effect the binder removal.

In one embodiment, the catalytic removal is thermally induced. For example, the thermally induced catalytic removal may occur during thermal debinding, sintering (provided a suitable process gas is present for at least proportion of the time during the sintering process) or a combination thereof. The carbon and/or oxygen content may also be additionally controlled during the heat treatment stages by increasing the temperature and/or regulating the process gases utilised.

In one embodiment, the catalytic removal occurs in an atmosphere comprising at least one reactive gas. In this instance, the reactive gas assists in the removal of the binder and/or binder residues.

In one embodiment, the catalytic removal occurs in an oxidising atmosphere, for example, an atmosphere comprising oxygen, $NO_2$, ozone (i.e. $O_3$) or a combination thereof. In one preferred embodiment, the atmosphere comprises oxygen (for example, air). In these embodiments, the catalytic removal is a catalytic oxidation process.

In another embodiment, the catalytic removal occurs in reducing atmosphere, for example, an atmosphere comprising hydrogen. In this embodiment it will be recognised by the skilled person in the art that the process gas utilised must be selected such that it is compatible with the material being formed. In this respect, hydrogen is generally not considered suitable for use in elevated temperature processing of titanium alloys as it may result in undesirable levels of hydride formation. In this embodiment, the catalytic removal is a catalytic reduction process.

The thermally induced catalytic removal may take place at one or more suitable temperatures. However, irrespective of the temperature or temperatures at which the catalytic removal occurs, it is desirable that the selected temperature or temperatures are above that suitable for the initiation of the catalytic removal and below that recognised to cause significant impurity uptake in the particular material being prepared.

It is possible to produce new alloys and cermets by the method of the present invention. It is believed that the ability to generate a tailored material with required properties (e.g. corrosion resistance and mechanical properties) would encourage the use of those materials and, in particular, the use of alloys, such as titanium alloys. It is also possible to produce purer cermets or alloys of known grades (e.g. titanium alloy compositions as listed in the ASTM International list of standard alloy grades). Regardless of the actual composition of the final material, an inventory of different powders and platinum group metals facilitates the fabrication of articles in a wider range of alloys or cermets. This is particularly advantageous for the manufacturer of small, intricate articles who does not manufacture in bulk and so cannot normally benefit from economies of scale.

The invention is further illustrated by reference to the following non-limiting Examples.

EXAMPLES

Example 1

CPTi and Ti6Al4V powders (<45 μm, spherical) from Advanced Powders & Coatings, Canada, were each mixed with a commercial binder formulation developed by Egide UK, Woodbridge, Suffolk. Mixing was carried out using a Winkworth Ltd. Z-blade mixer for a period of one hour to ensure a homogeneous feedstock. After mixing, the feedstock was further processed into the granular form used in the injection molding process.

Example 2

The above-mentioned powders and organic binder were mixed as in Example 1, with the additional inclusion of an amount of palladium black (Alfa Aesar), such that the Pd black formed approximately 0.2 wt. % of the amount of titanium or titanium alloy powder present in the feedstock mixture.

The molded components made using feedstocks prepared by the method outlined in this Example are hereafter referred to as having "admixed" Pd content.

Example 3

In a step prior to preparation of the feedstock, CPTi and Ti6Al4V powders (as above) were first coated in palladium, using the dual asymmetric centrifugal forces technique. For this example, the palladium used for the coating was in the form of palladium black.

Figure 3:
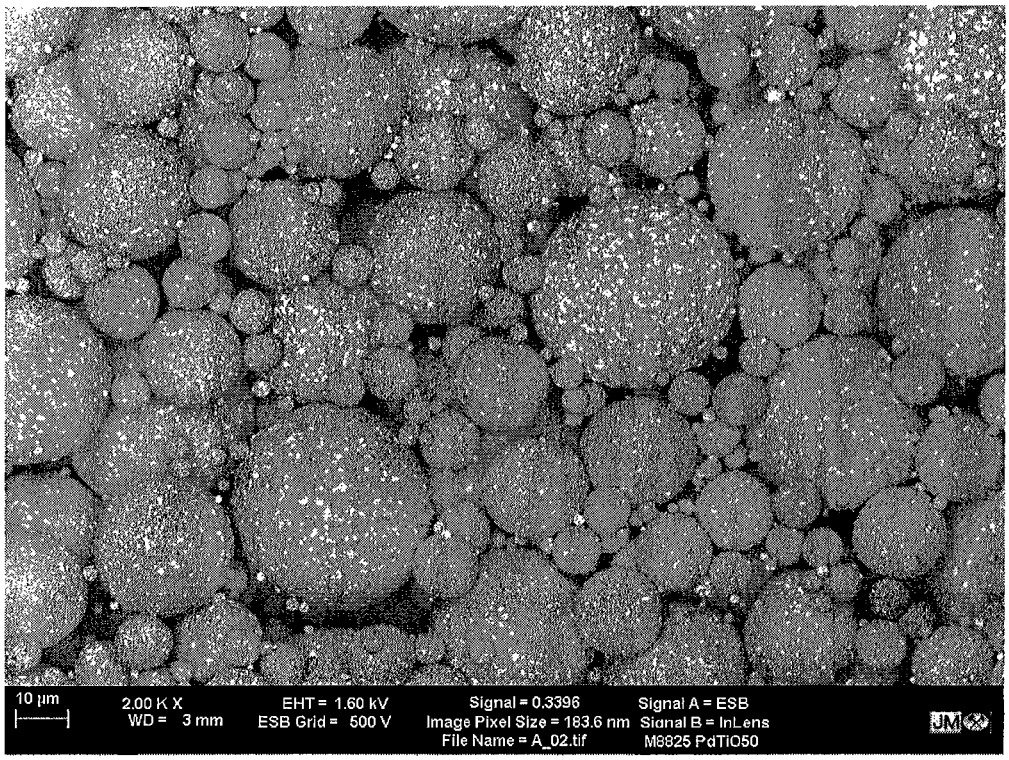
FIG. 3 is a backscattered electron image of 150 g titanium powder (<45 μm) coated with 0.2 wt % palladium. The dual asymmetric centrifugal forces were applied 3× for 20 seconds at 2000 rpm.

An amount of palladium black was added such that it formed approximately 0.2 wt. % of the amount of titanium or titanium alloy being coated. Dispersion measurements and SEM pictures were taken to ensure an even distribution of the Pd on the surface of the Ti powders (see FIGS. 2 and 3).

Said coated powders were subsequently mixed with the binder formulation and granulated, as outlined above. The molded components made using feedstocks prepared by the method outlined in this Example are hereafter referred to as having "surface-coated" Pd content.

Example 4

The granulated metal powder feedstocks, formulated in Examples 1-3, were compacted into "green" molded parts, each being complex in design but having an approximate total volume of 5 $cm^3$, using an Arburg Allrounder 270 Centex 40 Ton injection molding machine. Machine conditions were tailored to ensure efficient and complete filling of the mold and clean ejection of the molded parts.

Example 5

To remove the majority of the binder phase prior to the thermal sintering process, the molded "green" parts produced in Example 4 were subjected to a thermal treatment process. The "green" parts were maintained in an oxygen-containing atmosphere in a heated, well-ventilated, compartment (Genlab-bespoke oven). The total thermal cycle lasted for a period of over 24 hours.

Figure 4:
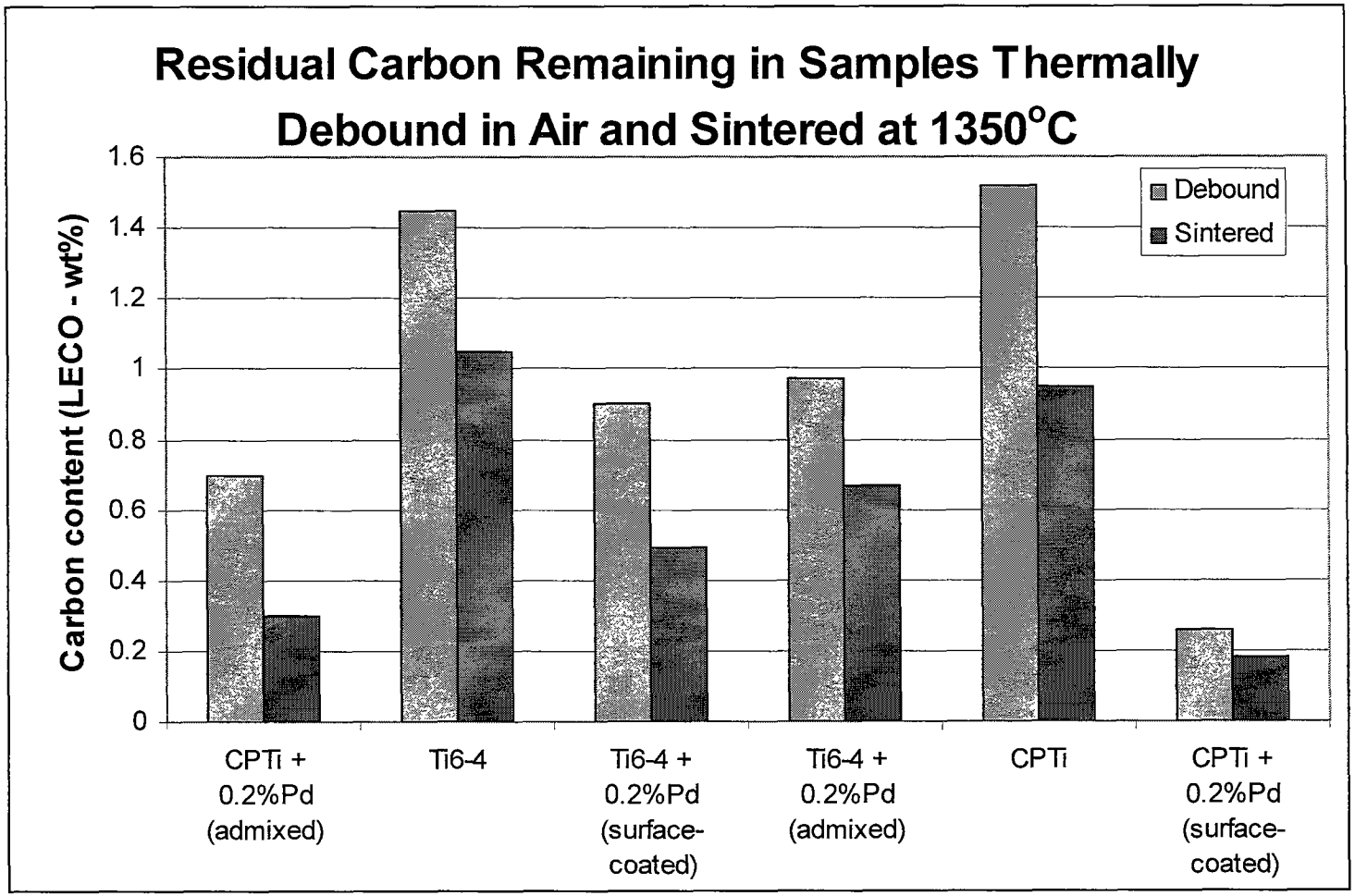
FIG. 4 is a graph illustrating the residual carbon remaining in samples thermally debound in air and sintered at 1350° C.
Figure 5:
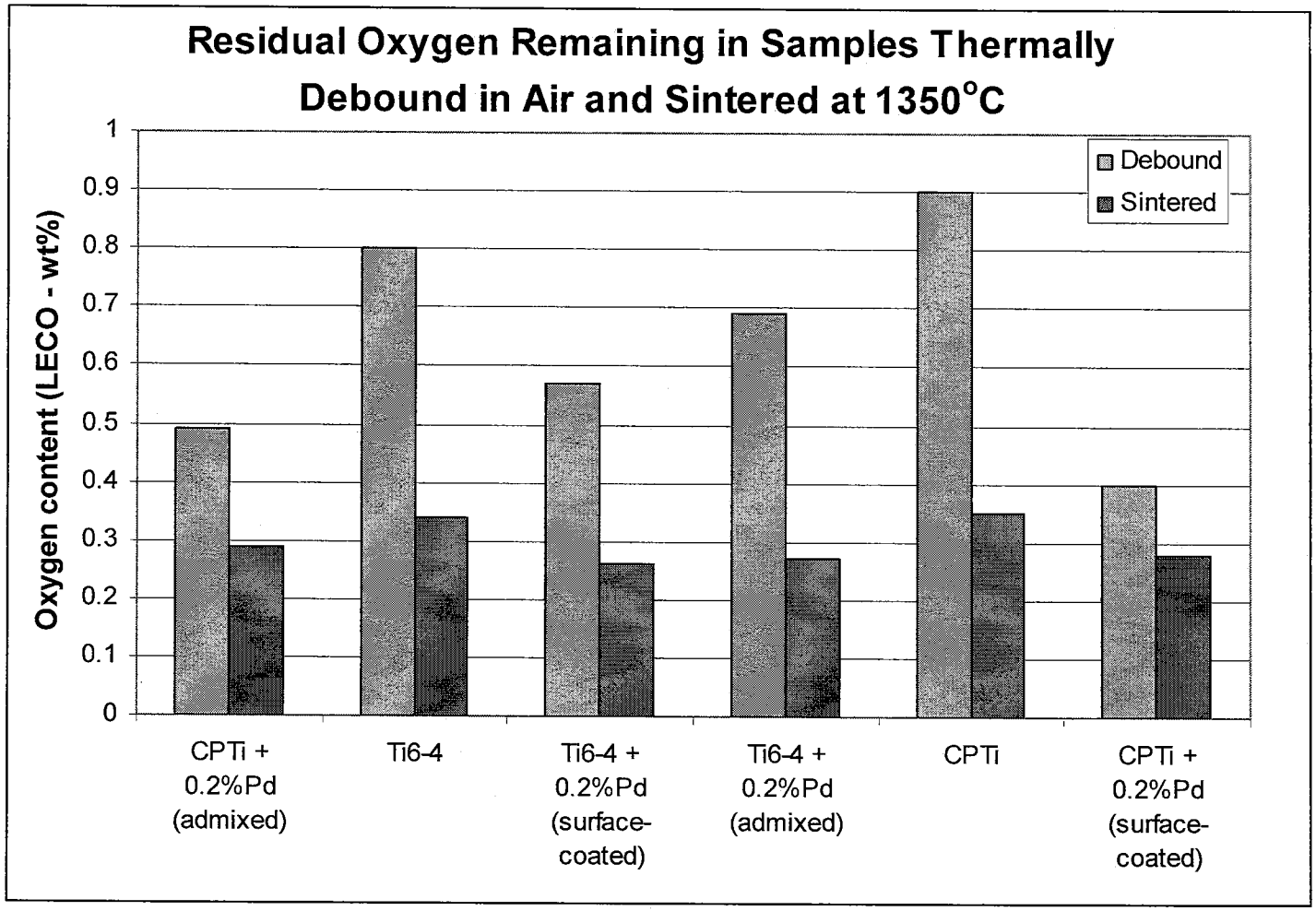
FIG. 5 is a graph illustrating residual oxygen levels in samples thermally debound in air and sintered at 1350° C.

During this processing step, the majority of the binder phase was removed from the molded "green" parts, producing fragile "debound" components also known commonly as "brown" parts. At the end of the thermal process the "brown" parts were examined for their residual carbon and oxygen contents. FIGS. 4 and 5 illustrate the residual carbon and oxygen remaining in samples debound in air.

Example 6

The fragile "brown" parts produced in Example 5 were sintered using a thermal cycle in a high-temperature vacuum oven (Centorr Vacuum Industries MIM-Vac M200 Vacuum/Controlled Atmosphere Debind and Sinter furnace, Series 3570). During the course of the overall sintering process and thermal cycle so employed, it is possible and sometimes desirable to introduce gas streams into the sintering furnace at certain points in the cycle. For example, hydrogen, nitrogen, argon or oxygen may all be present at some point in the overall thermal sintering process. In the case displayed within this Example, a small bleed of argon gas was introduced, typically 1-20 L/min, which was first scrubbed of oxygen using standard methods.

The peak temperature experienced during the process outlined in this Example was 1350° C. for a period of one hour, although such a sintering process is clearly possible using a range of suitable values for temperature and time in such a way that the powder sintering process is achieved.

After the sintering process was completed, the now metallic-looking parts were examined for their carbon and oxygen content (London & Scandinavian Metallurgical Laboratories, Sheffield). Typical values for titanium and titanium alloy parts having experienced the processes outlined in these Examples are shown in FIGS. 4 and 5.

Example 7

The corrosion behaviour of a solid CPTi+0.2 wt % Pd alloy, made by following the metal injection molding processes in Examples 1-6, was compared with that of wrought titanium Grades (Grade 2 (CPTi) and Grade 7 (Pd-0.2Ti)—both from Timet UK Ltd.). Polarisation curves were measured on surfaces ground to 1200 grit, washed in deionised water, rinsed in ethanol and then dried. Testing was performed in 150 ml of 2M HCl at 37° C. immediately after cleaning of the surface.

Figure 6:
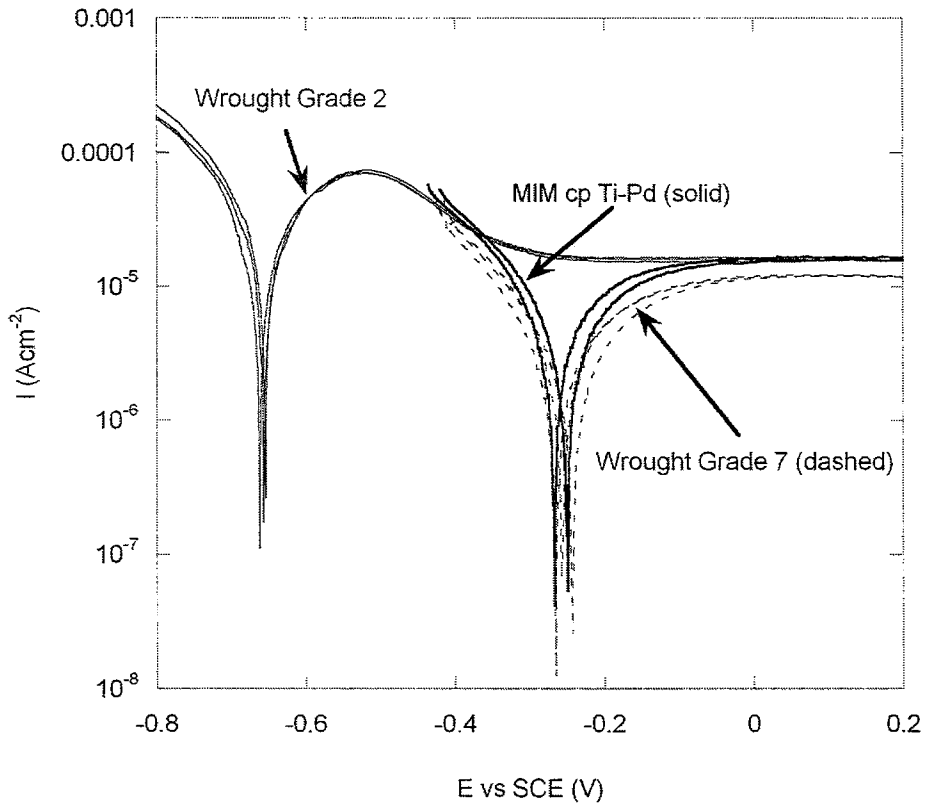
FIG. 6 is a graph illustrating the corrosion behaviour of a solid CPTi+0.2 wt % Pd alloy made according to the method of the present invention with that of wrought titanium Grades (Grade 2 (CPTi) and Grade 7 (Pd-0.2Ti)).

Polarisation curves, shown in FIG. 6, were measured after 30 minutes immersion at open circuit potential. Scans were carried out from −200 mV to +700 mV, relative to the open circuit potential, at 1 mV/second. Tests were carried out using a saturated calomel electrode (SCE) as the reference electrode and Pt wire as the counter electrode.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

The invention claimed is:

1. A method for controlling the content of at least one of carbon and oxygen in a material comprising the steps of:

a) forming a feedstock composition comprising at least one powder, at least one platinum group metal, and at least one binder; and b) forming the material by powder injection molding;

wherein at least a proportion of the content of at least one of carbon and oxygen is catalytically removed by the at least one platinum group metal, wherein the catalytic removal is thermally induced, and wherein the catalytic removal occurs in an oxidizing atmosphere comprising oxygen or a reducing atmosphere comprising hydrogen.

2. The method according to claim 1, wherein the feedstock composition is an admixture of the powder, the platinum group metal, and the binder.

3. The method according to claim 1, wherein the platinum group metal is coated onto the powder.

4. The method according to claim 3, wherein the platinum group metal is coated onto the powder by low energy ball milling, electroless plating, reductive chemical deposition or utilizing dual asymmetric centrifugal forces.

5. The method according to claim 3, wherein the platinum group metal is coated onto the powder utilizing dual asymmetric centrifugal forces.

6. The method according to claim 3, wherein the coating is in the form of a film or in the form of discrete particles.

7. The method according to claim 1, wherein the powder comprises at least one of titanium, molybdenum, tungsten, nickel, or iron.

8. The method according to claim 1, wherein the powder comprises at least one of silicon, zirconium, aluminum, yttrium, cerium, titanium, or tungsten.

9. The method according to claim 1, wherein the powder comprises particles which are substantially spherical, irregular, or a combination thereof.

10. The method according to claim 1, wherein the platinum group metal is selected from the group consisting of at least one of platinum, palladium, rhodium, ruthenium, iridium, and osmium.

11. The method according to claim 1, wherein the platinum group metal is selected from the group consisting of at least one of platinum and palladium.

12. The method according to claim 1, wherein the material is an alloy or a cermet.

13. The method according to claim 12, wherein the alloy comprises titanium.

14. The method according to claim 1, wherein the thermally induced catalytic removal occurs during thermal debinding, sintering, or a combination thereof.

15. The method according to claim 14, wherein the content of at least one of carbon and oxygen is further controlled by regulating process gases.

16. A method for controlling the content of at least one of carbon and oxygen in a material comprising the steps of:

a) forming a feedstock composition comprising at least one powder, at least one platinum group metal, and at least one binder; and b) forming the material by powder injection molding;

wherein at least a proportion of the content of at least one of carbon and oxygen is catalytically removed by the at least one platinum group metal, wherein the platinum group metal is coated onto the powder utilizing dual asymmetric centrifugal forces.

* * * * *